United States Patent [19]

Redmond

[11] Patent Number: 4,673,898

[45] Date of Patent: Jun. 16, 1987

[54] WIDE BAND QUADRATURE HYBRID

[75] Inventor: Kevin P. Redmond, Stuart, Fla.

[73] Assignee: Advanced Systems Research, Inc., Stuart, Fla.

[21] Appl. No.: 834,586

[22] Filed: Feb. 28, 1986

[51] Int. Cl.[4] ..... H01P 5/18

[52] U.S. Cl. ..... 333/109; 330/149; 329/133; 332/16 R; 332/45; 455/323

[58] Field of Search ..... 333/109, 112, 115, 116

[56] References Cited

U.S. PATENT DOCUMENTS 3,444,475 5/1969 Seidel ..... 333/109 X
4,485,360 11/1984 Seward ..... 333/109 X

FOREIGN PATENT DOCUMENTS 2612758 10/1977 Fed. Rep. of Germany ..... 333/109

OTHER PUBLICATIONS

Marcatili et al, *Broad-Band Directional Couplers,* IRE Trans. on MTT, Jul. 1962, pp. 251-257.

*Primary Examiner*—Paul Gensler
*Attorney, Agent, or Firm*—Kevin Redmond

[57] ABSTRACT

A system for providing a quadrature hybrid with a wide bandwidth and an extremely low amplitude imbalance. This system incorporates conventional quadrature hybrids as components and provide a system quadrature hybrid having a larger bandwidth and a far lower amplitude imbalance than that of any of the component quadrature hybrids. Typically, the system bandwidth improvement over that of the component hybrids is 60 percent, while the improvement in the imbalance is 6 to 1. These improvements are achieved using a system network consisting fundamentally of three conventional hybrids, a reversing divider and an in-phase divider, all of which are readily available components. This system provides a significant improvement over more complicated quadrature hybrid designs where filter networks are required to obtain wide bandwidth. The widest bandwidth components now abailable, including those using filter networks, can be incorporated in the present invention to provide an even wider system bandwidth.

6 Claims, 11 Drawing Figures

WIDE BAND QUADRATURE HYBRID

BACKGROUND

Quadrature hybrids designed for use below 500 MHz are typically employed in IF processing circuitry. Although these hybrids are found in a wide variety of applications, their full potential has not been realized because of their large imbalance in output amplitude, and in many cases, their relatively narrow bandwidth.

Although the principles presented herein may be applied to different types of hybrids, the specific class of hybrid which will be considered for illustrative purposes is the 3 dB quadrature hybrid also referred to as the 3 dB quadrature coupler. These hybrids are fundamentally four port devices that accept a signal at an input port, divide the signal in half internally and then supply the divided signal to two output ports. In an ideal quadrature hybrid, the difference in the phase angle between the output ports remains at 90 degrees and the amplitude of the output signals remain equal across the useful bandwidth of the device. There is essentially no output from the fourth port as it is isolated from the input port, and in many instances, such as in the systems illustrated herein, this port is terminated internally.

In a practical, currently available hybrid, the difference in phase angle between the outputs of the hybrid over its useful bandwidth does in fact approach the ideal of 90 degrees; however, the output amplitudes do not approach the ideal of remaining equal. Typically, the outputs differ by as much as 1.0 to 1.5 dB. In most applications, it is this imbalance in amplitude, rather than the difference in phase angle that limits the usefulness of the hybrid.

In conventional hybrids, there are large amplitude imbalances at midband and even larger imbalances at the band edges. Since the phase angle remains at nearly 90 degrees, it is these large imbalances at the band edges that determines the usable bandwidth of conventional hybrids. In many cases, the imbalance results in a relatively narrow bandwidth. Table 1 shows the bandwidth and amplitude imbalance of three conventional hybrids.

TABLE 1

| DEVICE | FREQ RANGE BAND-WIDTH | AMPLITUDE IMBALANCE TYPICAL | AMPLITUDE IMBALANCE MAXIMUM |
|---|---|---|---|
| CONVENTIONAL 1 | 30–50 MHz | 1.0 dB | 1.5 dB |
| CONVENTIONAL 2 | 40–70 | 1.0 | 1.5 |
| CONVENTIONAL 3 | 55–90 | .8 | 1.2 |

FIG. 1A is a graph of the amplitude response of a conventional hybrid. It can be seen from this Figure that the amplitude imbalance of this conventional hybrid exceeds 1.4 dB at 30 MHz. Because of the large imbalance at the band edges and in particular at 30 and 90 MHz, the usable bandwidth of this hybrid is considered to be only 40 to 80 MHz. It should be noted that the bandwidth of the amplitude response shown in FIG. 1 is an octave which is relatively wide. Many conventional hybrids in this frequency range have bandwidths that are only 10 percent of their center frequency.

There are two types of special multi-octave quadrature hybrid that are currently available; however, these are not available from many sources and each has serious drawbacks. The first type is fabricated in stripline using multisection couplers. This type of hybrid is generally not available below 100 MHz and, even at that relatively high IF frequency, it is quite large, occupying more than 24 square inches of board space. The maximum amplitude imbalance is 2 dB and there are three bandpass ripples. The smallest ripple results in an imbalance of one dB.

The second type of multioctave quadrature hybrid that is currently available is fabricated from ferrite cores. It has a maximum amplitude imbalance of 1.3 dB and an insertion loss of 4 dB. In addition, it also has a passband slope of over 1 dB with four ripples creating amplitude imbalances which approach one dB. The area required for mounting is less that of the stripline type, but is still typically a square inch or more. Neither type of multioctave hybrid is capable of providing the low amplitude imbalance provided by the present invention which is in the order of 0.2 dB or less.

SUMMARY

An object of the present invention is to provide a quadrature hybrid that exhibits nearly equal output amplitudes over its entire frequency range.

An object of the present invention is to provide a quadrature hybrid that exhibits a nearly constant output over its entire frequency range.

An object of the present invention is to provide a network that extends the useful frequency range of quadrature hybrids.

An object of the present invention is to provide a system quadrature hybrid which incorporates component quadrature hybrids and provides an improved uniformity in the output amplitudes of the system quadrature hybrid over that which can be obtained from the component hybrids alone.

The present invention is a system which, in one form, comprises three component quadrature hybrids, an in-phase and a 180 degree combiner connected to take advantage of the unique phasing characteristics of quadrature hybrids. This system has the unusual ability to provide a system quadrature hybrid with a bandwidth and amplitude imbalance that are significantly better than that of the component hybrids used to form the system.

DETAILED DESCRIPTION OF THE INVENTION

Figure 2:
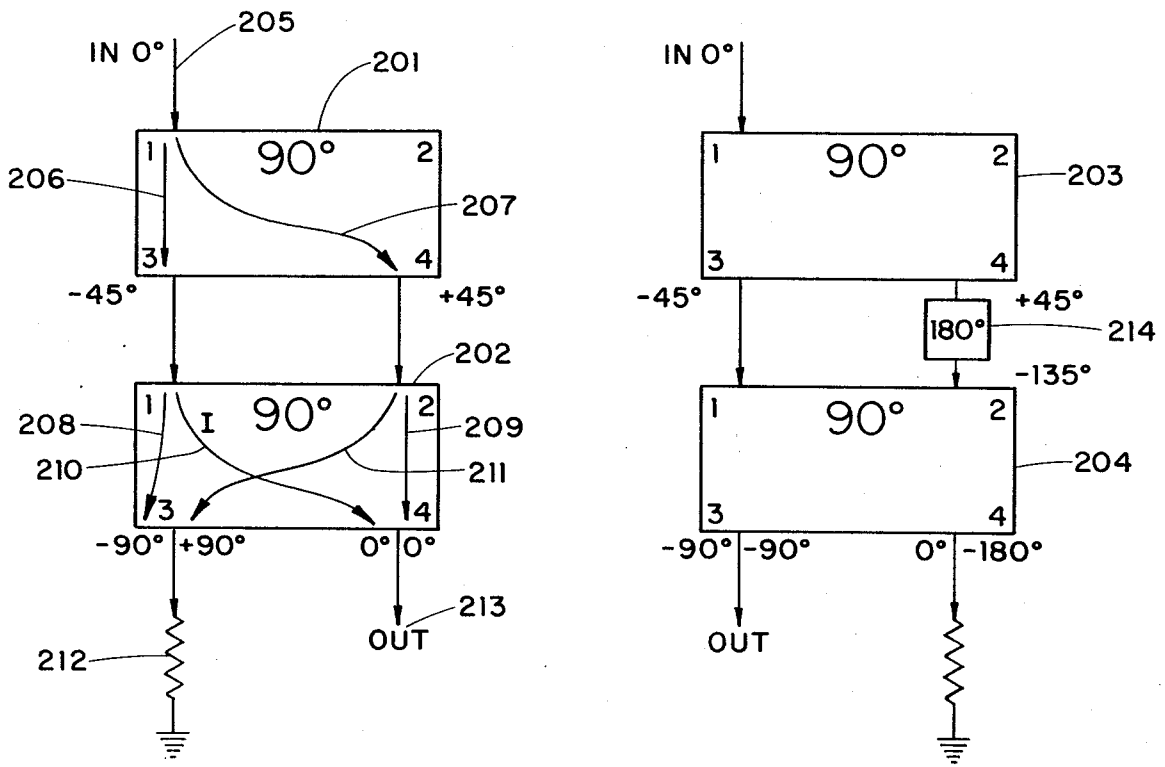
FIG. 2 is a block diagram of four quadrature hybrids, illustrating the phasing relationship of signals through two sets of two quadrature hybrids connected in tandem, one set having the two quadrature hybrids directly connected and the other set having a 180 degree phase shifter connected between the two quadrature hybrids.

The unique vector summing characteristics of quadrature couplers, which are essential to the operation of the present invention, are illustrated in FIG. 2. This Figure comprises four quadrature couplers 201 through 204, each having four similar ports numbered 1 through 4. The ports designated 2 on couplers 201 and 203 are internally terminated. In this Figure, an input signal 205 is fed to port 1 of coupler 201 where it is divided to supply output ports 3 and 4 which are 90 degrees apart in phase. The relative phase of these output ports with respect to the input are taken for illustrative purposes as −45 degrees for port 3 and +45 degrees for port 4. Output ports 3 and 4 of coupler 201 are fed to input pots 1 and 2 of coupler 202. The signal at each input port is divided and follows paths such as 208 and 210 for port 1 and 209 and 211 for port 2. These signals combine at ports 3 and 4 of coupler 202. At port 3 these signals are equal, out of phase and cancelling, while at port 4 these signals are in-phase and reinforcing.

The arrangement of couplers 203 and 204 is identical to that of couplers 201 and 202 with the exception that a 180 degree phase shifter 214 is inserted between port 4 of coupler 203 and port 2 of coupler 204. The insertion of the 180 degree phase shifter causes cancellation and reinforcement in the output ports of coupler 204 to be reversed with cancellation occurring at port 4 and reinforcement occurring at port 3. In addition, the phase angle of the outputs from coupler 202 and 204 are different. The phase angle of the output from coupler 202 at port 4 is 0 degrees, while the phase angle of the output from coupler 204 at port 3 is −90 degrees.

Figure 3A:
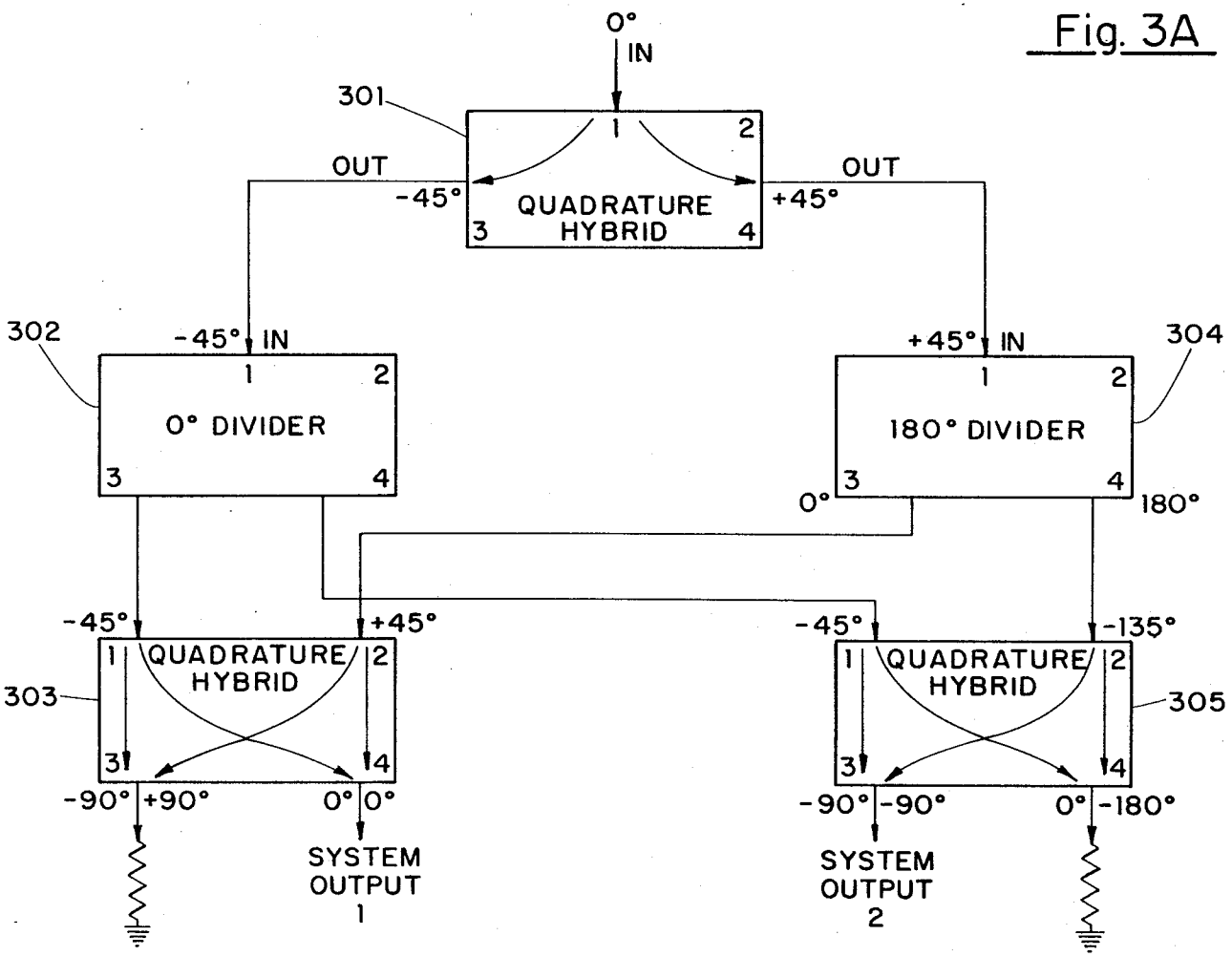
FIG. 3A is a block diagram of the present invention.

By using these unique phasing additions occurring in the quadrature hybrid arrangements shown in FIG. 2 and averaging the outputs through the addition of a zero degree and a 180 degree combiner as shown in FIG. 3A, the desired smoothing of the output response and the narrowing of the difference between the outputs can be achieved. FIG. 3A comprises three quadrature couplers 301, 303, and 305, a zero degree divider 302, and a 180 degree divider 304. All of these devices have four ports numbered 1 through 4; however, in coupler 301 and in both dividers port 2 is terminated internally.

In FIG. 3A, the outputs 3 and 4 of coupler 301 are each supplied to a different divider. The output from port 3 at −45 degrees is supplied to the input port 1 of the zero degree divider 302, while the output from port 4 at +45 degrees is supplied to the input port 1 of the 180 degree divider 304. The output signals from ports 3 and 4 of the dividers are supplied to one port of different quadrature hybrids, 303 and 305. That is, each divider supplies half its output power to a different quadrature hybrid. Since the input to each divider is derived from a different output port of the first quadrature hybrid, 301, the output from the quadrature hybrids 303 and 305 will be the result of the sum of a portion of the power from each of the output ports from the first quadrature hybrid 301. The addition averages the outputs from quadrature hybrid 301 narrowing the amplitude difference between output ports while maintaining the desired 90 degree phase difference between the output ports. The existence of the 90 degree difference between the system output ports can be seen by noting that the output from the quadrature coupler 303 at port 4 is zero degrees, while the output at port 3 of coupler 305 is −90 degrees. The signals arriving at the remaining output ports of quadrature hybrids 303 and 305 cancel, requiring all the power delivered to these couplers to be delivered at only one port per coupler.

The phasing of the signals to provide the 90 degree output between the ports can be understood by examining the phasing occurring in FIG. 2. The phasing of the signals in quadrature hybrid 202 is similar to that occurring in quadrature hybrid 303 and the phasing in hybrid 204 is similar to that occurring in hybrid 305.

Where the quadrature hybrids are of identical construction and characteristics, variations in the output of each individual coupler over its passband due to variations in the coupling tend to be cancelled in the arrangement of FIG. 3 as can be seen by tracing the coupled and direct paths through the three quadrature hybrids.

Figure 3B:
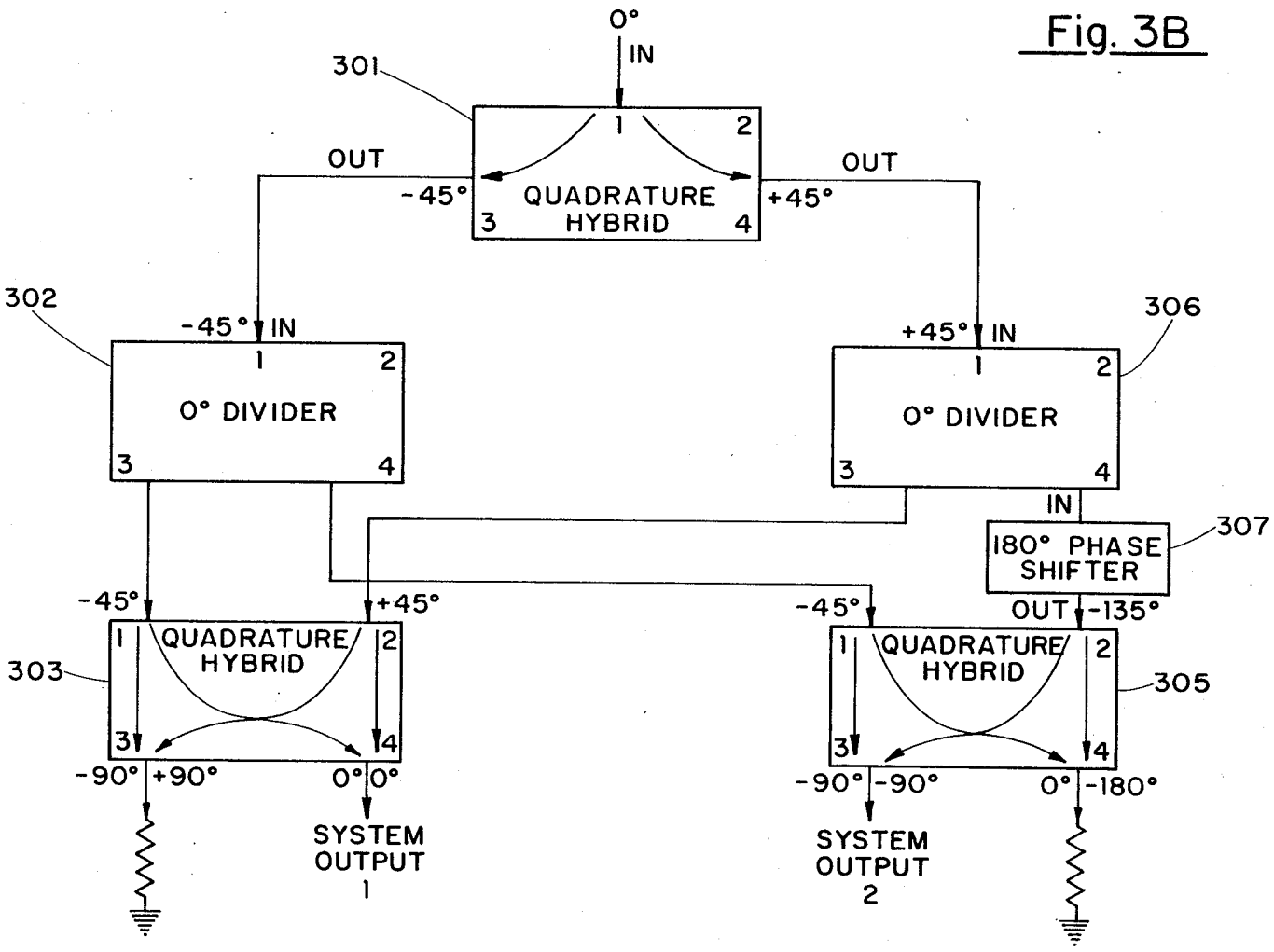
FIG. 3B is a block diagram of an alternate form of the present invention.

An alternate form of the invention is shown in FIG. 3B. This Figure is identical to FIG. 3A with the exception that the 180 degree divider 304 has been replaced by a zero degree divider 306 and a 180 degree phase shifter 307. The zero degree divider 306 includes an input port 1, an isolated port 2, and output ports 3 and 4. The 180 degree phase shifter 307 includes an input and an output port. Output port 4 of the quadrature hybrid 301 is connected to input port 1 of the zero degree divider 306. Output ports 3 and 4 of of divider 306 are connected to input port 2 of the quadrature hybrid 303 and the input port of the 180 degree phase shifter, respectively. The output port of the 180 degree phase shifter 307 is connected to input port 2 of quadrature hybrid 305.

The operation of this configuration is identical to that shown in FIG. 3A. The only difference is a 180 degree power divider is created from a zero degree power divider by adding a 180 degree phase shifter in series with one output port of the zero degree divider.

Figure 1A:
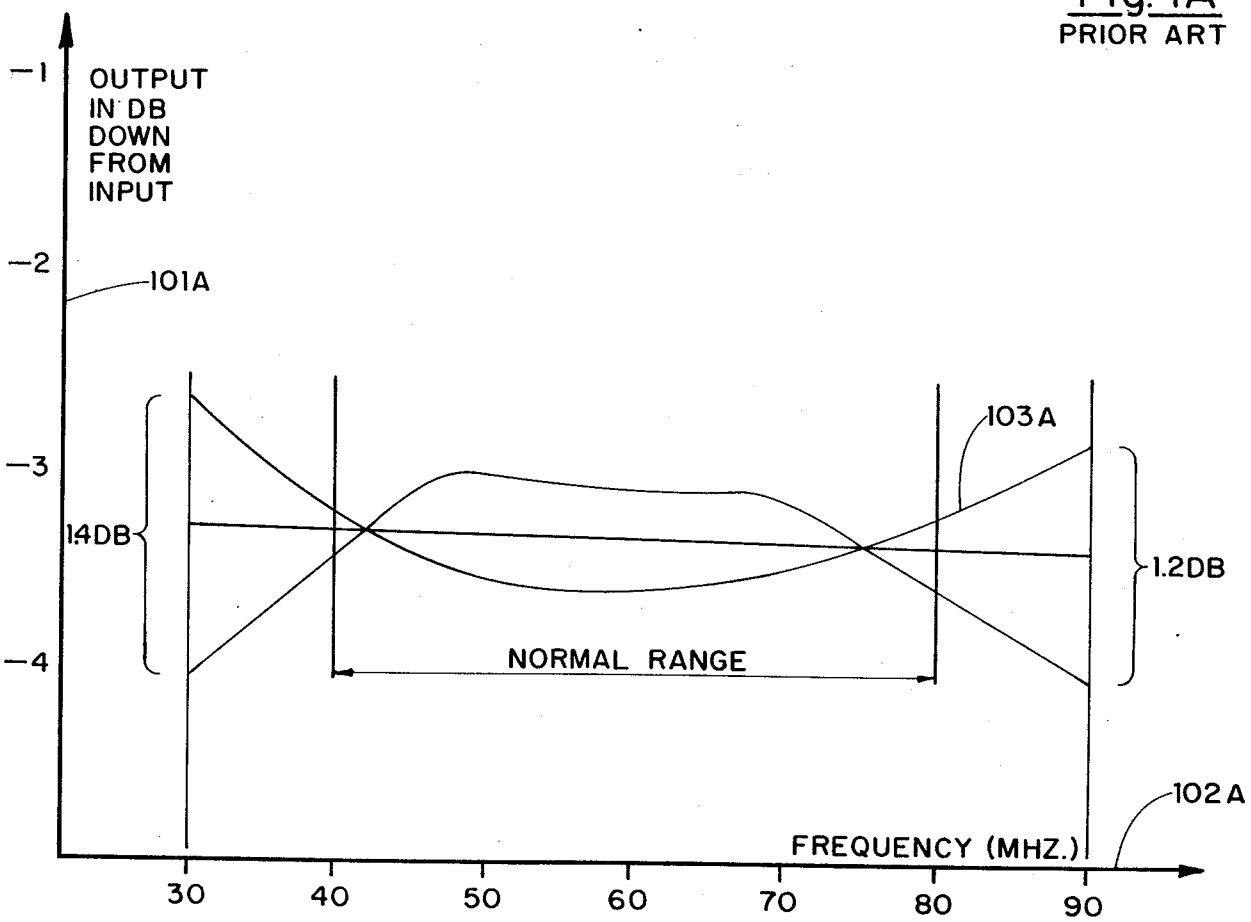
Fig. 1A PRIOR ART
FIG. 1A is a graph showing the amplitude response of a conventional quadrature hybrid.
Figure 1B:
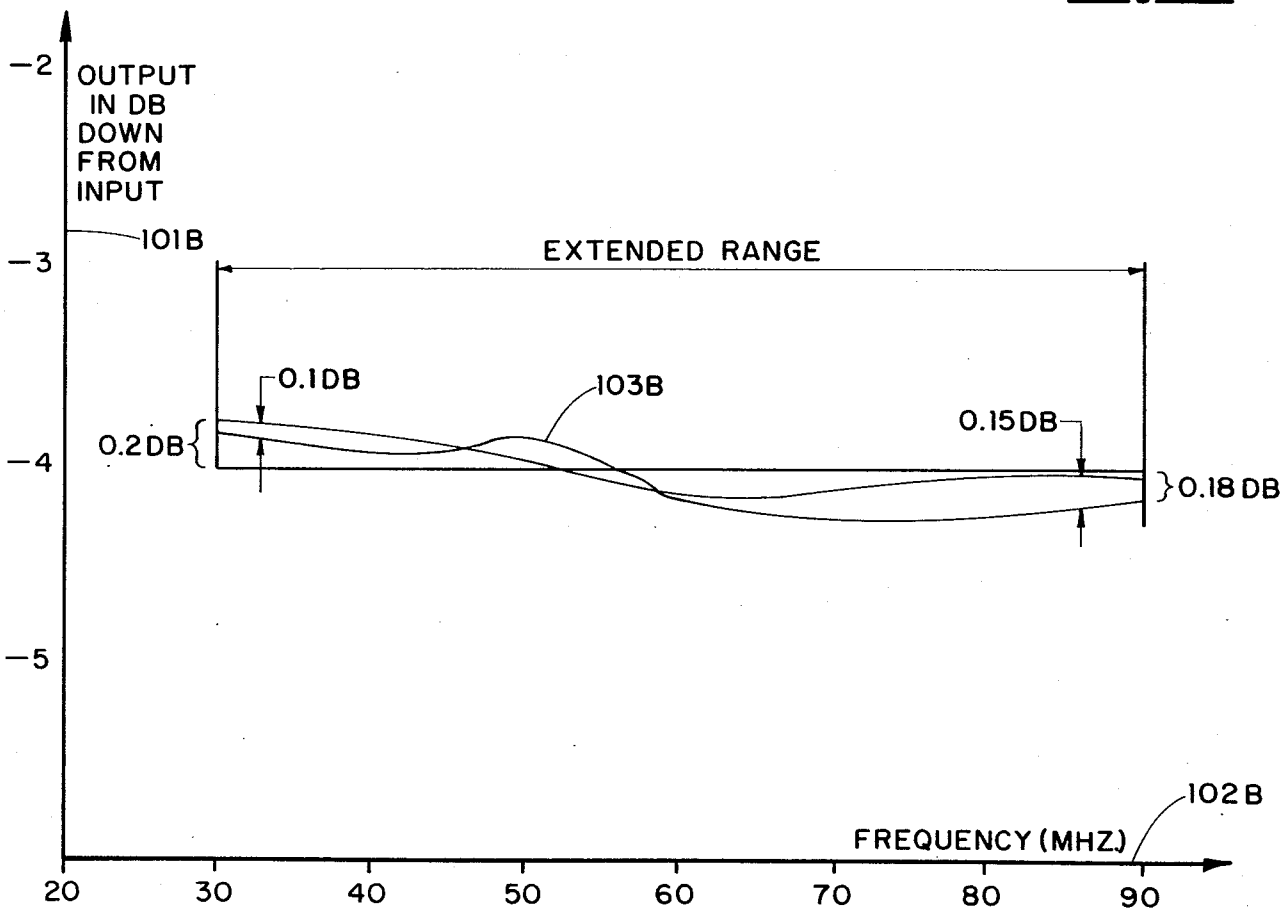
FIG. 1B is a graph of the amplitude response of the present invention incorporating three quadrature hybrids which have the characteristic shown in FIG. 1A.

The improvement in performance of the arrangement of FIG. 3 can be seen by comparing the output of a conventional quadrature hybrid, shown in FIG. 1A, with that produced by the the arrangement of FIG. 3, shows in FIG. 1B. FIG. 1A is a graph comprising an ordinate 101A representing insertion loss, an abscissa 102A representing frequency and a characteristic curve 103A representing the insertion loss of a conventional quadrature hybrid. FIG. 1B is a graph comprising an ordinate 101B representing insertion loss, an abscissa 102B representing frequency, and a characteristic curve 103B representing the insertion loss of a system quadrature hybrid constructed in accordance with the present invention.

As can be seen, a divergence between the outputs of as much as 1.4 dB in the characteristic of the conventional coupler shown in FIG. 1A was narrowed to 0.1 dB in the characteristic of the system coupler shown in FIG. 1B. The system coupler of FIG. 1B was fabricated using couplers having characteristics similar to that shown in FIG. 1A. A deviation from a flat response of 0.8 dB was reduced to plus or minus 0.25 dB. The wide variation in the output of the conventional coupler at its band edges tend to narrow the useful bandwidth; however, by using the present invention, the useful bandwidth is extended while at the same time the bandpass ripple is reduced. There is a 0.6 dB increase in the insertion loss of the system coupler. This is normally not a problem in a system application where a system amplifier can easily accommodate such a small additional insertion loss.

The amplitude characteristic of the coupler shown in FIG. 1B has a negative slope in addition to the added insertion loss of approximately 0.6 dB. Even though these characteristics, which are found in conventional multi-octave hybrids, do not generally pose any serious problem to IF processing circuitry, it is possible to eliminate them. One method of eliminating these characteristics is through the use of a shaping amplifier contained within the hybrid.

Figure 4C:
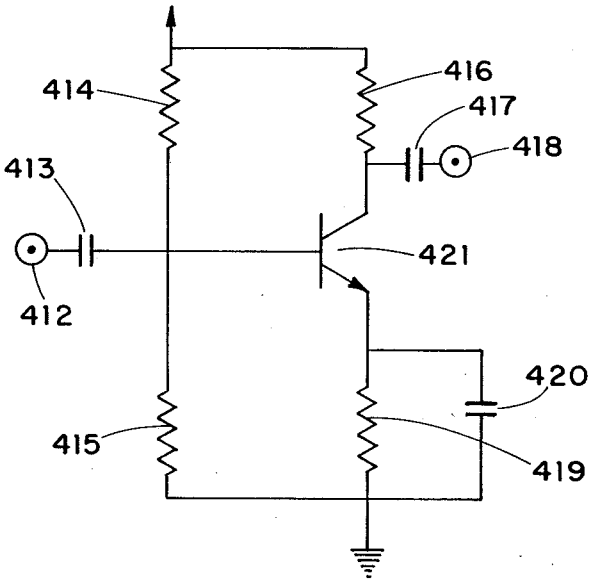
FIG. 4C is a schematic of a shaping amplifier.
Figure 4A:
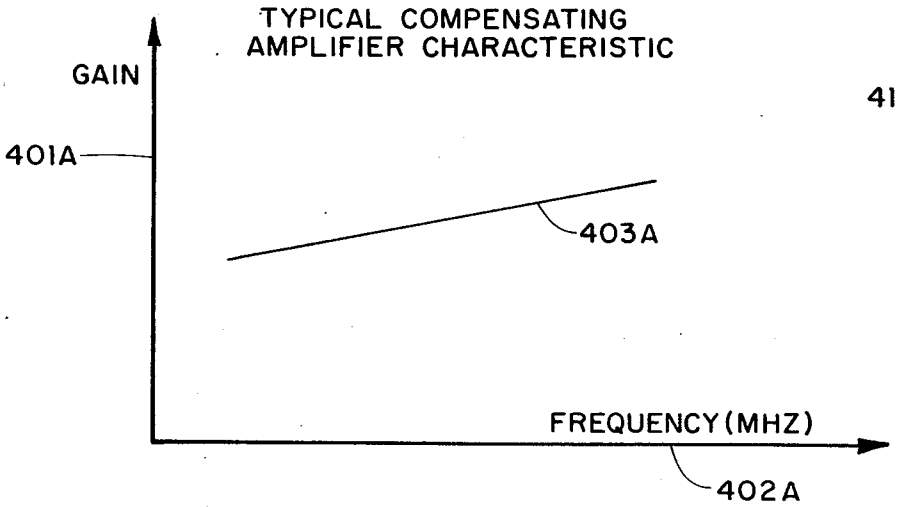
FIG. 4A is a graph showing the gain versus frequency characteristic of a shaping amplifier.

FIG. 4A shows the plot of the gain of a shaping amplifier designed to compensate the roll-off in the insertion loss characteristic of a system quadrature hybrid with a characteristic similar to that shown in FIG. 1B. FIG. 4A comprises an ordinate 401A representing gain, an abscissa 402A representing frequency and a characteristic curve 403A representing the gain of a compensating amplifier as a function of frequency.

This characteristic may be achieved in a number of ways. One way is to partially bypass the emitter resistor of a common emitter transistor amplifier with a capacitor that has a reactance comparable to the emitter resistance over the frequency range of interest. Such an amplifier is shown in schematic form in FIG. 4C. This amplifier schematic comprises an input port 412, a collector resistor 416, an output port 418, a first coupling capacitor 413, a second coupling capacitor 417, a first bias resistor 414, a second bias resistor 415, an emitter resistor 419, an emitter bypass capacitor 420, and a transistor 421.

Where the emitter bypass reactance is comparable to the resistance of the emitter resistor, the gain of the amplifier will increase with increasing frequency because the capacitive reactance of the emitter bypass capacitor is reduced as the frequency is increased and the negative feedback produced by the impedance in the emitter circuit is reduced. The positive gain slope is the opposite of that usually produced by a system quadrature hybrid and therefore this amplifier provides a simple and effective means of compensating the gain response of a system quadrature hybrid.

The shaping amplifier is placed in series with the input port to insure that the 90 degree phase angle difference between the output ports is unaffected. FIG. 4D shows the frequency response of a system quadrature hybrid incorporating an integral shaping amplifier designed to eliminate loss and flatten the response. FIG. 4D comprises an ordinate 401D representing insertion loss or gain, an abscissa 402D representing frequency and a characteristic curve 403D of a system quadrature hybrid. It can be seen from FIG. 4D the insertion loss is reduced to zero decibels and the output is flat within 0.2 dB from 27 to 127 MHz and within 0.5 dB from 17 to 147 MHz. This latter bandwidth has a large bandwidth ratio of 8 to 1 and a maximum imbalance of only 0.25 dB.

Figure 4B:
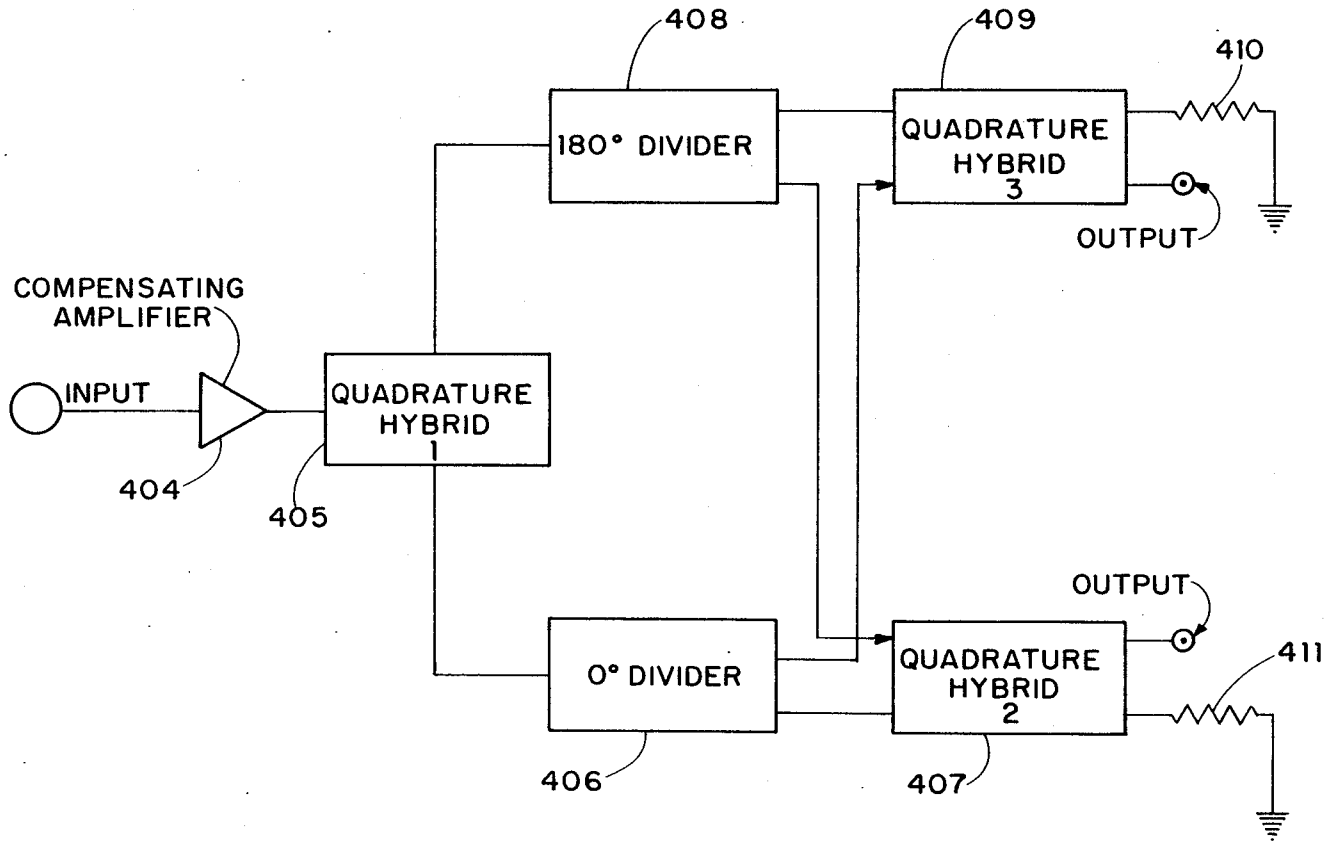
FIG. 4B is a block diagram of the present invention incorporating a shaping amplifier.
Figure 4D:
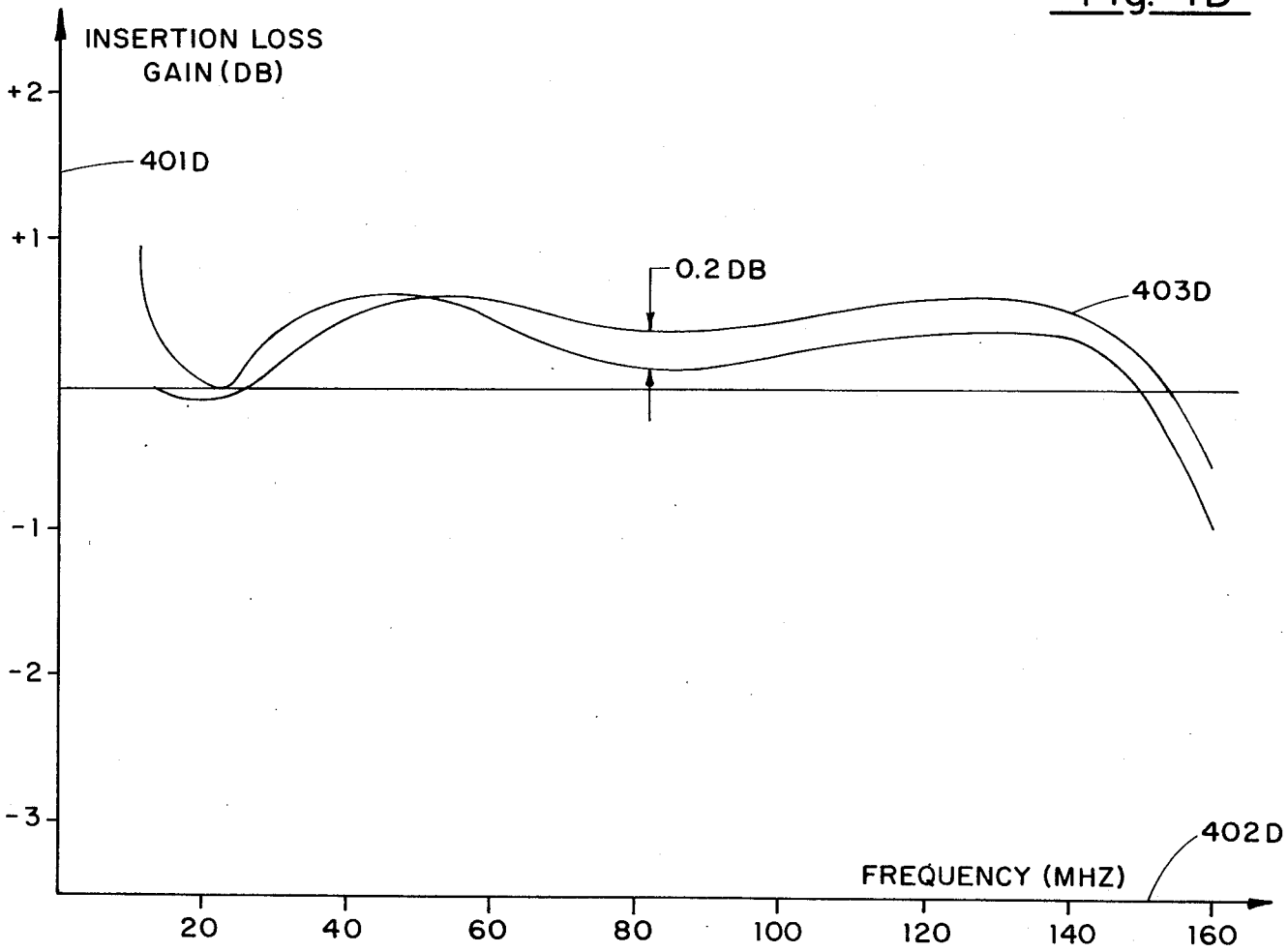
FIG. 4D is a graph showing the gain versus frequency characteristic of a system quadrature hybrid in which the gain has been compensated by an integral shaping amplifier.

FIG. 4B is a block diagram of a system incorporating a shaping amplifier. This Figure comprises a shaping amplifier 404, first, second and third component quadrature hybrids 405, 407, and 409, zero degree divider 406, and 180 degree divider 408. The connection of the component hybrids and the dividers is the same as that shown in FIG. 3 to form a system quadrature hybrid; however, the shaping amplifier is connected in series with the input port of the system hybrid to compensate for the roll off in gain and added insertion loss of the system hybrid without affecting the phase relationship of the output signals.

Figure 5:
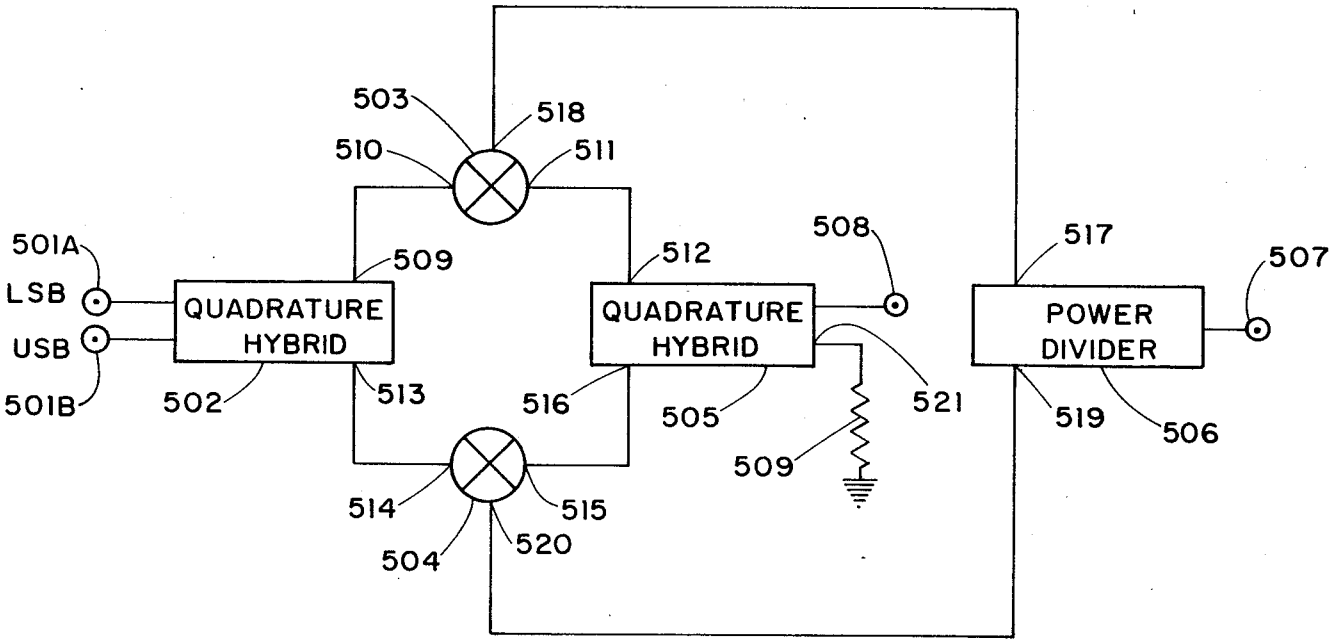
FIG. 5 is a block diagram of a circuit which may be used as a single sideband modulator or as an image reject mixer.
Figure 6:
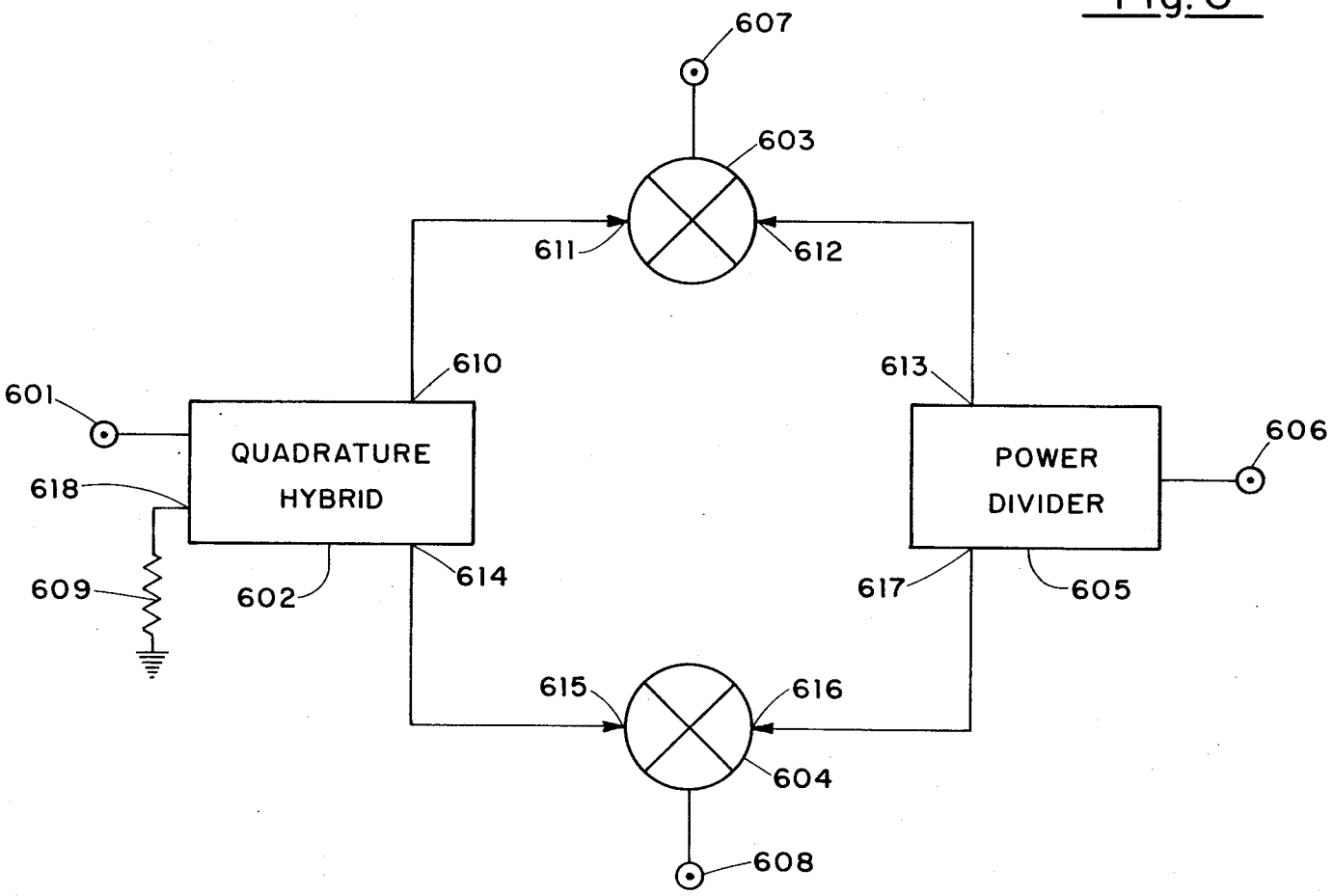
FIG. 6 is a block diagram of a circuit which may be used as an I&Q phase detector or as a vector modulator.

The advantages of the present invention may be illustrated by considering practical applications. FIG. 5 shows a circuit configuration that may be used for either a single sideband modulator or image reject mixer, while FIG. 6 shows a circuit configuration that may be used for either an I & Q phase detector or a vector modulator. FIG. 5 comprises a first quadrature hybrid 502, a second quadrature hybrid 505, a first mixer 503, a second mixer 504, a power divider 506. Quadrature hybrid 502 includes ports 501A, 501B, 509 and 513. A signal applied to port 509 will result in the signal being divided and supplied to ports 501A and 501B, while port 513 will receive no signal as it is isolated from port 509. Qadrature hybrid 505 has ports 508,512,516, and 521. A signal supplied to port 508 will be divided and supplied to ports 512 and 516, while port 521 will receive no signal as it is isolated from port 508. These hybrids are recriprocal. For example, a signal applied to port 501A of hybrid 502 will divide the signal and supply it to ports 509 and 513, while port 501B will receive no signal as it is isolated from 501A.

Mixer 503 has ports 510, 511, and 518. Mixer 504 has ports 514, 515, and 520. For the sake of simplicity, these mixers are assumed to be of the type that any port can be used for any function such as local oscillator input, RF input, or IF output. Powder divider 506 has ports 507, 517 and 519. A signal supplied to port 507 will be divided and supplied to ports 517 and 519. The power divider is a recriprocal device. Equal, in-phase signals applied to ports 517 and 519 will combine and appear at port 507. When used in this latter mode of operation, this device is usually referred to as a combiner, rather than a divider.

To complete the system, the following ports are connected: 509 to 510, 511 to 512, 513 to 514, 515 to 516, 517 to 518, and 519 to 520. Port 521 is termined in resistor 509.

FIG. 6 comprises a quadrature hybrid 602, attenuators 603 and 604 and a power divider 605. Quadrature hybrid 602 includes ports 601, 610, 614, and 618. A signal applied to port 601 will divide between ports 610 and 614, while port 618 receives no signal as it is isolated from port 601. Attenuator 603 includes ports 607, 611, and 612, while attenuator 604 includes ports 608, 615, and 616. The attenuators receive control signals on ports 607 and 608 which control the signals passing through the attenuators between ports 611 and 612 and 615 and 616, respectively. Power divider 605 includes ports 606, 613 and 617. A signal applied to port 606 will be divided and supplied to ports 613 and 617. To complete this system, the following ports are connected: 610 to 611, 612 to 613, 614 to 615 and 616 to 617. Port 618 is terminated in resistor 609. The quadrature hybrids in FIGS. 5 and 6 may be conventional devices, but improved performance will be provided if the system quadrature hybrids of the present invention are used in place of conventional devices, as will be shown below.

In the operation of the circuit of FIG. 5, the RF and LO signals are supplied to ports 507 and 508. These signals are mixed in mixers 503 and 504 to provide the upper and lower sideband signals to ports 501A and 501B. To obtain only one sideband signal at each port, the other sideband signal must be cancelled. In order to achieve cancellation, these signals to be cancelled must be opposite in phase and equal in amplitude. How close these signals are to being perfectly opposed is dependent on the phase error which is due in part to the deviation from the ideal 90 degree phase difference between the output ports of the quadrature hybrids. This is normally within 3 degrees of the ideal and often within one degree. The effect of such phase errors is small. For example, a phase error of one degree changes the level of cancellation products or suppression level by only a few dB at most.

On the other hand, the amplitude error, which is the deviation from amplitude equality, has a much greater effect on cancellation. The error is only 0.2 dB for the present invention, but can be 1.0 dB or more for a conventional hybrid. Where the amplitude error is only 0.2 dB, cancellation is good and the suppressed products are down, as much as 38 dB; however, where the amplitude error is 1 dB, the cancellation is poor and the suppressed products are down only 24 dB at best. The present invention is therefore capable of providing as much as a 14 dB improvement in performance for image reject mixers and capable of providing this improvement over several times the bandwidth of most conventional hybrids.

The effect of the amplitude error on the circuit configuration of FIG. 6 can be determined by considering this circuit as a vector modulator. In this application, the quadrature hybrid 602 accepts an input signal at port 601 and divides it into two quadrature components which are ideally of equal amplitudes. The attenuators 603 and 604 have the ability to reverse phase as well as attenuate the aplied quadrature signal components. The attenuators adjust the amplitudes of these quadrature components and supply them to power divider 605 to produce a resultant signal vector at port 606 at any desired phase angle. Any amplitude error affects the resultant phase angle. Where the amplitude error is 1.0 dB, as in the case of the conventional hybrid, the resultant phase error can be in excess of 3 degrees; however, where the amplitude error is only 0.2 dB, as in the case of the present invention, the resultant phase error is only a maximum of 0.7 degrees.

It is evident from these examples that the present invention can be applied to a number of circuits to achieve significant performance advantages. An additional advantage of the present invention is that it is sufficiently small to be contained in a package suitable for PC board mounting. For example, the present invention with a shaping amplifier can be placed on a PC board in an area of only 0.56 inch.

There are many possible modifications and variations of the present invention which become evident to those skilled in the art in the light of the principles disclosed herein. Such modifications and variations are considered as falling within the spirit and scope of the present invention.

One quite useful example of such a variation is the application of three system quadratures as component quadrature hybrids in an even larger or compound system quadrature hybrid. That is, in the systems shown in FIGS. 3A and 3B, each component quadrature hybrid is replaced by a system quadrature hybrid. Such a compound system quadrature hybrid has been fabricated and tested. The improvement in bandwidth is illustrated by noting that a component quadrature hybrid with a 2:1 bandwidth produced a compound system quadrature hybrid with a bandwidth of 8:1.

Having described my invention, I claim:

1. A system quadrature hybrid comprising:

(a) a first, a second and a third component quadrature hybrid, each component quadrature hybrid being configured similarly, and each having four ports, the first and second ports being designated input ports and the third and fourth ports being designated output ports, wherein, power supplied to an input port is divided and supplied to the two output ports in quadrature phase relationship, (b) a first and a second zero degree power divider, each divider having an input and a first and a second output port, (c) a 180 degree phase shifter having an input and an output port, and, (d) means for making multiple connections, said means connecting the third port of the first quadrature hybrid to the input port of the first power divider, the fourth port of the first quadrature hybrid to the input port of the second power divider, the first output port of the first power divider to the first port of the second quadrature hybrid, the second output port of the first power divider to the first port of the third quadrature hybrid, the first output port of the second power divider to the second port of the second quadrature hybrid, the second output port of the second power divider to the input port of the 180 degree phase shifter, and the output port of the 180 degree phase shifter to the second port of the third quadrature hybrid, to provide a system in which a signal applied to the first port of the first quadrature hybrid will be divided and emerge from the fourth port of the second second quadrature hybrid and the third port of the third quadrature hybrid in quadrature phase relationship and with amplitudes that are more nearly equal over a wider bandwidth than that provided by any of the component quadrature hybrids forming the system quadrature hybrid.

2. A system quadrature hybrid comprising;

(a) A first, a second, and a third component quadrature hybrid, each component quadrature hybrid being configured similarly, and each having four ports, the first and second ports bing designated input ports and the third and fourth ports being designated output ports, wherein power supplied to an input port is divided and supplied to the two output ports in quadrature phase relationship, (b) A zero degree power divider having an input port and a first and a second output port, (c) A 180 degree power divider having an input and two output ports with one of the output ports being a 180 degree port, the output ports being designated the first and second output ports and the second output port being the 180 degree port which lags the first output port by 180 degrees. and (d) Means for making multiple connections, said means connecting the third port of the first quadrature hybrid to the input port of the zero degree divider, the fourth port of the first quadrature hybrid to the input port of the 180 degree divider, the first output port of the zero degree divider to the first port of the second quadrature hybrid, the second output port of the zero degree divider to the first port of the third quadrature hybrid, the first output port of the 180 degree divider to the second port of the second quadrature hybrid, the second output port of the 180 degree divider to the second port of the third quadrature hybrid, to provide a system hybrid in which a signal applied to the first port of the first quadrature hybrid will be divided and emerge from the fourth port of the second quadrature hybrid and the third port of the third quadrature hybrid in quadrature phase relationship and with amplitudes that are more nearly equal over a wider bandwidth than that provided by any of the component quadrature hybrids forming the system quadrature hybrid.

3. A system as claimed in claim 2, having the zero degree and the 180 degree power divider as well as the interconnection configuration between three component quadrature hybrids as recited in claim 2, but wherein each component quadrature hybrid of this claim is itself of the type produced by the system quadrature hybrid arrangement claimed in claim 2, making each component quadrature hybrid of this claim contain internally three quadrature hybrids and the system quadrature hybrid of this claim, referred to as a compound system quadrature hybrid, actually contain a total of nine quadrature hybrids.

4. A system as claimed in claim 2, further comprising a shaping amplifier, said shaping amplifier being connected in series with the first port of the first component quadrature hybrid and said shaping amplifier having a gain characteristic which varies in slope in a sense opposite to that of the system hybrid over its operating frequency range to compensate the system quadrature hybrid and provide a flatter and more constant overall output level than is provided by the system quadrature hybrid alone.

5. A system as claimed in claim 4 wherein the system quadrature hybrid gain as a function of frequency has a negative slope and the shaping amplifier has a slope that is equal in magnitude, but is positive in sense and therefore opposite to that of the quadrature hybrid.

6. A system as claimed in claim 5, wherein the shaping amplifier is a common emitter amplifier which contains an emitter resistor and a bypass capacitor connected across the emitter resitor, said common emitter amplifier having a positive gain slope as a function of frequency obtained by partially bypassing the emitter resistor with the emitter bypass capacitor.

* * * * *